United States Patent [19]

Yagi et al.

[11] Patent Number: 4,665,731

[45] Date of Patent: May 19, 1987

[54] BENDING APPARATUS

[75] Inventors: Sigenori Yagi; Junosuke Yagi, both of Hyogo, Japan

[73] Assignee: Sinsei Mfg. Co., Ltd., Hyogo, Japan

[21] Appl. No.: 816,160

[22] Filed: Jan. 3, 1986

[30] Foreign Application Priority Data

Apr. 23, 1985 [JP] Japan ..... 60-87250

[51] Int. Cl.[4] ..... B21D 7/022

[52] U.S. Cl. ..... 72/307; 72/294; 72/388

[58] Field of Search ..... 72/307, 306, 294, 316, 72/319, 322, 388, 384, 217–219

[56] References Cited

U.S. PATENT DOCUMENTS

| | | | |
|---|---|---|---|
| 2,382,745 | 8/1945 | Powers | 72/7 |
| 3,145,756 | 8/1964 | Hill | 72/7 |
| 3,373,587 | 3/1968 | Shubin et al. | 72/307 |
| 3,493,016 | 2/1970 | Ott | 72/307 |
| 3,986,381 | 10/1976 | Shubin et al. | 72/217 |
| 4,000,636 | 1/1977 | Shubin et al. | 72/217 |
| 4,033,388 | 7/1977 | Ruegger | 72/294 |
| 4,555,924 | 12/1985 | Remy et al. | 72/307 |

*Primary Examiner*—Daniel C. Crane

*Attorney, Agent, or Firm*—James E. Nilles

[57] ABSTRACT

A bending apparatus wherein a long material to be bent is inserted into an axial guide hole of a cylindrical material guide, the bending direction of the long material being determined by a bending direction setting body which is provided rotatably on the outer periphery of the material guide and set in any desired rotational position, and the long material is bent by a bending operation body which is provided in front of the bending direction setting body rotatably around a support shaft set to be perpendicular to the material to be bent and has a material insertion portion formed facing the fore end of the material guide.

4 Claims, 5 Drawing Figures

BENDING APPARATUS

BACKGROUND OF THE INVENTION

1. Field of the Invention

The present invention relates to a bending apparatus for bending long materials such as wire rods, bars and tubes.

2. Description of the Prior Art

Wire forming parts manufactured by bending wire rods such as iron wires and hard steel wires are used for numerous products, including cushion frames for automobile seats and household electric appliances such as oven toasters, for instance. For manufacturing these parts, special purpose machines such as a power press, an oil hydraulic press,, a multi-press, a bender using a pneumatic cylinder and a bore slide have been used widely in general.

Each of the aforesaid apparatuses requires a die or a similar special purpose jig and necessitates a number of processes for manufacturing parts, which results in an increase in cost therefor.

Moreover, each of said apparatuses is fixed in the bending direction, and thus it can not bend materials in any other desired directions.

SUMMARY OF THE INVENTION

The present invention is designed to solve the above-described problems, and an object thereof is to make it possible to bend materials freely and easily in desired directions and at desired angles with no need to employ any die or similar special purpose jig.

The bending apparatus of the present invention is equipped with a cylindrical material guide having an axially extending guide hole through which a material to be bent can pass with a close fit, a bending direction setting body which is provided rotatably on the outer periphery of said material guide for establishing the direction of bend in any desired rotational position, and a bending operation body supported on the front of said bending direction setting body to be rotatable therewith and relative thereto around a support shaft that defines a bending axis perpendicular to said material and having a material insertion slot aligned with the front end of the aforesaid material guide.

In the bending apparatus of the present inven- tion, the material to be bent is made to pass through the guide hole of the material guide, the fore end of this material is put through the material insertion slot of the bending operation body and fed forward by a prescribed length, the bending direction setting body is rotated to a prescribed angular position about the material to set the bending direction of the bending operation body, and the bending operation body is rotated at a prescribed angle around the support shaft that is perpendicular to said material,, so as to bend this material.

Other objects and characteristics of the present invention will be described hereunder with reference to drawings.

DESCRIPTION OF THE PREFERRED EMBODIMENTS

Figure 1:
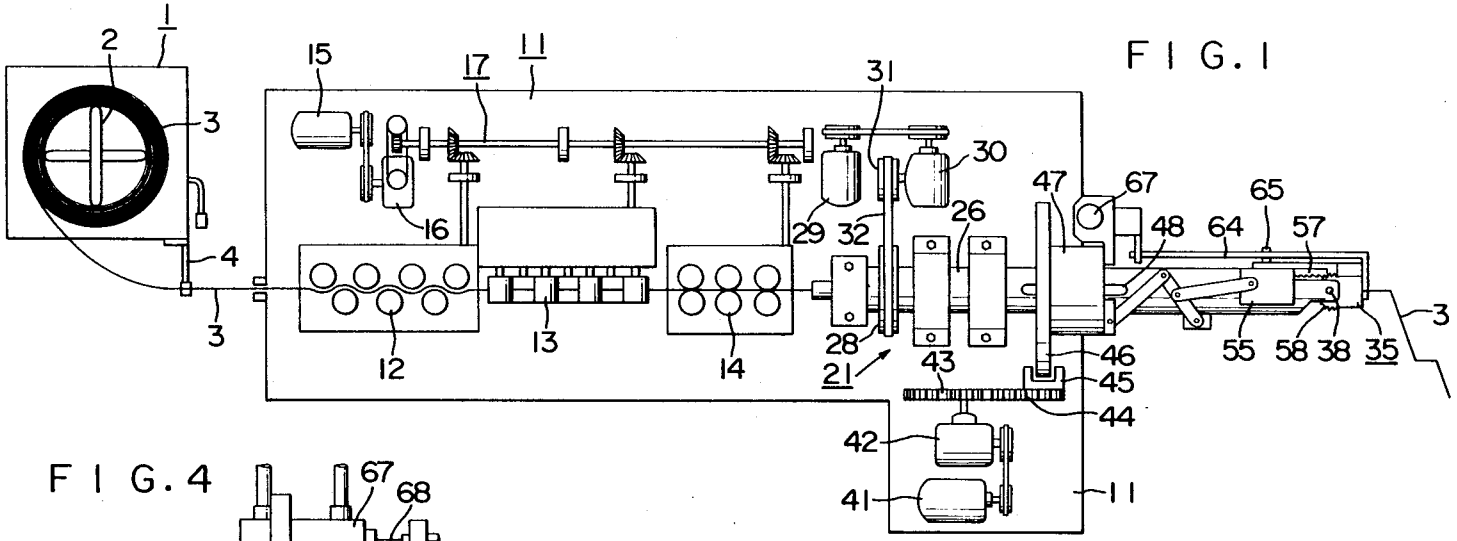
FIG. 1 is a plan view of one embodiment of a bending apparatus of the present invention.

In FIG. 1, numeral 1 denotes a reel stand, in which a material (wire) 3 to be bent, such as an iron wire or a hard steel wire, is wound around a reel 2 rotated by a variable-speed motor not shown therein. On this reel stand a projecting arm 4 is provided for synchronizing a bending speed in the main body of a forming machine described below with a speed of supply of the material in the reel stand.

The main body of the forming machine comprises correcting roll devices 12,13 for straightening the material 3 and a chucking roll device 14 for preventing turning of the material, all of which are arranged sequentially on a stationary base 11 and driven by a servo motor 15 on said base 11, through the intermediary of a transmission mechanism 17 composed of a reduction gear 16, a bevel gear, etc.

Moreover, a bending apparatus 21 is provided in front of said chucking roll device 14 on said base 11.

Figure 2:
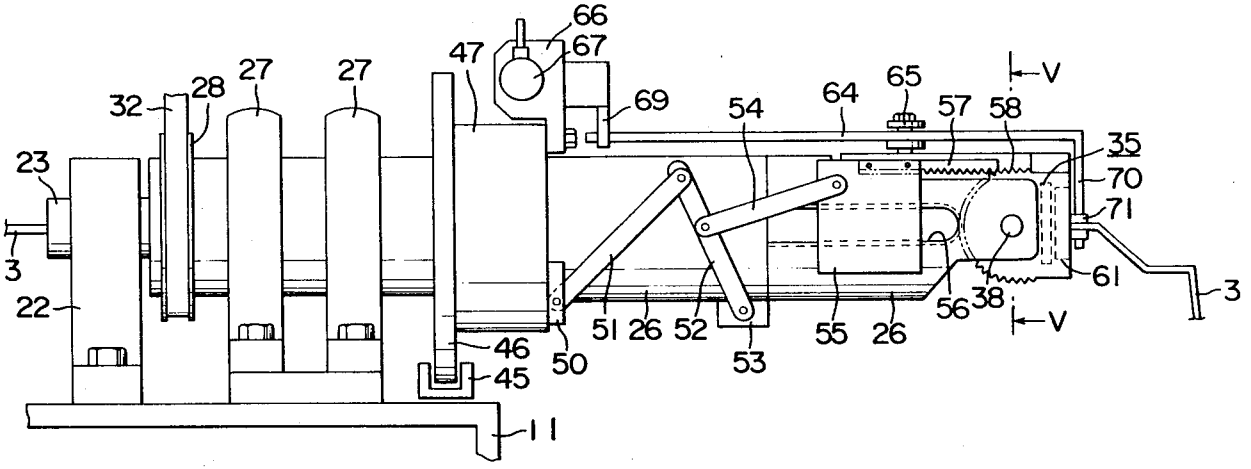
FIG. 2 is an enlarged side view of the principal part of FIG. 1.
Figure 3:
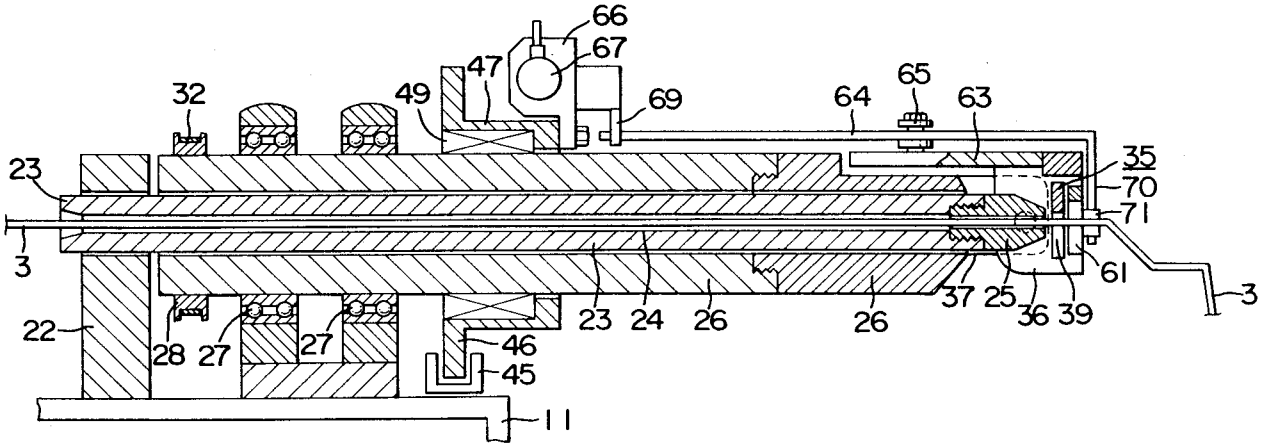
FIG. 3 is a sectional view thereof.

As is shown in FIGS. 2 and 3, this bending apparatus comprises a cylindrical material guide 23 held by a bearing 22 fixed on the base 11. A guide bore 24 extends in the axial direction through the central portion of said material guide 23, and further a substantially-conical bending head 25, which is replaceable according to the diameter of the material 3, is secured to the front end of the material guide 23. The bending head 25, which is coaxial with the guide bore 24 and through which the material is fed forward, confines the material laterally.

Moreover, a cylindrical bending direction setting body 26 concentrically surrounds the aforesaid material guide 23 and is supported for rotation about the axis of the guide bore 24 by front and rear bearings 27 on the base 11. Furthermore, a pulley 28 is provided on the rear end of this bending direction setting body 26, and, as shown in FIG. 1, an endless timing belt 32 is stretched around that pulley and a pulley 31 of a reduction gear 30 driven by a stepping motor 29 on the base 11, for controlling the bending direction.

Driven by said stepping motor 29 through the reduction gear 30 and the endless timing belt 32, the bending direction setting body 26 is rotatable through 360 degrees to a desired angular position around the material guide 23. The bending direction body has at its front end a pair of forwardly projecting laterally spaced support members 37.

Figure 5:
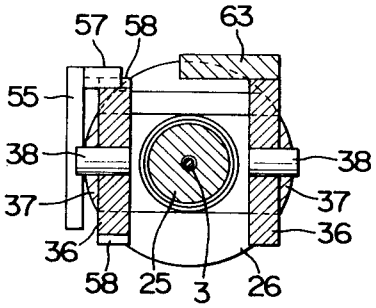
FIG. 5 shows a section taken along a line V—V of FIG. 2.

A bending operation body 35 carried by the support members 37 is disposed between them and facing the bending head 25 that is positioned at the fore end of the aforesaid material guide 23. Opposite-side plate portions 36 of this bending operation body 35 are rotatably supported between the pair of support members 37 on coaxial shafts 38 that are fixed to those support members and define a bending axis which extends perpendicular to the axis of the guide bore 24 and hence perpendicular to the material 3 to be bent, as shown in FIG. 5. Rotation of the bending direction setting body 26 brings the bending axis to any desired orientation.

Figure 4:
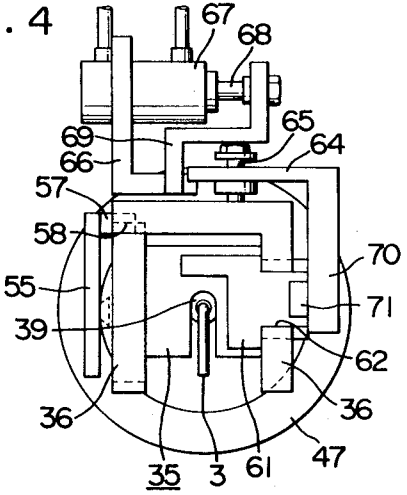
FIG. 4 is a front view thereof.

As is shown in FIGS. 3 and 4, the bending operation body 35 is substantially U-shaped so that it defines between its legs a material insertion slot 39 that opens to its lower portion and extends to its center, which is opposite the front end of the head of the material guide 23.

Moreover, as is shown in FIG. 1, a stepping motor 41 for controlling bending angle and a reduction gear 42 driven by this motor are provided on the base 11, a pinion 43 being provided at the output shaft of said reduction gear, a rack 44 being made to engage with this pinion, and an indented member 45 being provided on said rack 44.

Furthermore, a rotary drum 47, which has a circular flange part 46 formed integrally and fitted in said indented member 45, is put on the outer peripheral surface of the bending direction setting body 26 so that it can slide in the axial direction along a key groove 48 formed in said outer peripheral surface and be constrained to rotate therewith.

As is shown in FIGS. 2 and 3, the aforesaid rotary drum 47 is put on the aforesaid bending direction setting body 26 through the intermediary of a slide bearing 49, and one end of a link 51 is supported freely rotatably by an axial support member 50 provided on the front of this rotary drum 47, while one end of a link 52 is fitted freely rotatably to the other end of said link 51. Moreover, the other end of said link 52 is supported freely rotatably by an axial support member 53 provided on the lower portion of the bending direction setting body 26, and one end of a link 54 is supported freely rotatably by the middle portion of said link 52, while the other end of the link 54 is supported freely rotatably by a slide plate 55.

This slide plate 55 is fitted slidably in a dovetail groove 56 extending in the axial direction on the lateral side of the aforesaid bending direction setting body 26, and a rack 57 is fixed on the top of the slide plate and is made to engage with a pinion 58 formed on the side plate portion 36 at one side of the bending operation body 35. The pinion 58 is concentric to the bending axis.

Being driven by the stepping motor 41 through the intermediary of the reduction gear 42, the pinion 43, the rack 44 and the indented member 45, the rotary drum 47 is made to slide in the axial direction to move the slide plate 55 forward and backward through the intermediary of the links 51, 52 and 54 and thereby to rotate the bending operation body 35 through a desired angle around the support shafts 38 as a supporting point, through the intermediary of the rack 57 and the pinion 58.

Furthermore, as is shown in FIG. 4, a part of a movable cutting blade 61 is slidable on the front surface of the aforesaid bending operation body 35, which serves as a fixed shearing blade. The cutting blade 61 is guided slidably in a dovetail groove 62 provided on one side plate portion 36 of the bending operation body 35, and, as shown in FIG. 3, the middle portion of a cutting blade operating lever 64 is supported freely rotatably by a supporting axis 65 on the top of an axial support plate 63 which is provided integrally on the upper portion of the bending operation body 35. In addition, a hydraulic cylinder 67 is fixed on the front side of the aforesaid rotary drum 47 through the intermediary of a bracket 66, and a member 69 for pressing laterally against the rear end of said lever 64 is fitted to the piston rod 68 (FIG. 4) of this hydraulic cylinder. At the front end of the lever 64 a cutting blade operating member 70 is formed that projects vertically downward, and this operating member 70 is so designed as to engage with an abutment member 71 that projects forward on the front side of said cutting blade 61.

When a forming operation is ended, the lever 64 is swung by the cylinder 67, said projecting member 71 is engaged by said operating member 70 to move the cutting blade 61 to the left in FIG. 4, and the material 3 is cut off by this blade 61 and the bending operation body 35.

Next, a description will be made of the whole of the operation of the machine.

The material 3 to be bent is drawn out of the reel stand 1, fed forward through the correcting roll devices 12 and 13 and the chucking roll device 14 and further through the guide hole 24 in the material guide 23, and led to the material insertion slot 39 of the bending operation body 35. The material 3 is straightened by the correcting roll devices 12 and 13, while turning of the material 3 is prevented by the chucking roll device 14.

Meanwhile, the bending direction setting body 26 is driven by the stepping motor 29 to rotate to a prescribed angle, and the bending operation body 35 is rotated integrally with said body 26 to a prescribed angular position of the bending axis. By this operation the bending direction of the material 3 is established.

Next, the rotary drum 47 is driven by the stepping motor 41 through the intermediary of the pinion 43 and the rack 44 to slide in the axial direction, thereby the slide plate 55 is moved in the axial direction through the intermediary of the link mechanism, the bending operation body 35 is rotated around the support shafts 38 as a supporting point through the intermediary of the rack 57 and the pinion 58, and the material 3 is forced laterally by the bending operation body 35 to be bent thereby about the head 25 of the material guide as a basis. Accordingly, the bending angle of the material is determined in accordance with the amount of movement of the aforesaid drum 47 based on the amount of rotation of the aforesaid motor 41.

The material 3 to be bent being fed by a prescribed length into the material guide 23 in this way, the part of the material projecting from the head 25 of this material guide is bent to be formed at a desired angle (120 degrees at the maximum), which is determined by the angular displacement of the bending operation body 35, in a desired direction which is determined by the rotational angle of the bending direction setting body 26. By repeating this operation, that is, by setting the rotational position of the bending direction setting body 26 and the rotational angle of the bending operation body 35, the material 3 is formed to a prescribed shape sequentially, and is cut off lastly by the cutting blade 61 operated by the hydraulic cylinder 67, whereby a product is obtained.

In this case, any desired bending is enabled by numerically controlling the drive and stop of the motors 15, 29 and 41 by means of a microcomputer.

The present invention can be applied not only to a wire rod of the embodiment, but also to such materials as a bar, a tube, etc.

Effect of the Invention

According to the present invention, a material to be bent is bent at an arbitrarily set angle, while it projects from the material guide by the bending operation body whose bending direction is controlled by the rotation of the bending direction setting body, and thus this material can be bent freely and easily in a desired direction and to a desired angle.

What is claimed is:

1. Apparatus for bending elongated material such as wire, comprising a tubular bending head through which material to be bent is advanced lengthwise in a forward direction and which has a guide bore opening to a front end thereof that defines a bore axis and wherein the material has a close slidable fit to be confined laterally, a direction setting body surrounding said bending head and having means thereon defining a bending axis that is transverse to said bore axis, said direction setting body being adjustably rotatable about said bore axis for disposing said bending axis in any desired orientation, and a bending operation body movable in opposite directions about said bending axis and engageable with a portion of the material that projects forwardly beyond the front end of the bending head for bending the same, said apparatus being characterized by:

A. said bending axis being near said bore axis and rearwardly adjacent to the front end of said bending head;

B. said bending operation body comprising (1) a substantially U-shaped member having (a) a pair of legs connected by a laterally extending bight portion, (b) an elongated slot between said legs which is of a width to closely receive the material and which has an inner end adjacent to said bight portion that is adapted to apply bending force to the material, and (c) a flat front surface portion on each of said legs, said surface portion on one of said legs being coplanar with that on the other and extending to said slot to define a shearing edge thereat, and (2) means on said U-shaped member cooperating with said means that defines the bending axis to mount the U-shaped member on the direction setting body forwardly adjacent to said front end of the bending head and with its said legs on opposite sides of said bore axis, and to confine the U-shaped member to swinging about the bending axis relative to the direction setting body whereby said inner end of said slot is carried across the bore axis for applying bending force to material projecting forward from the bending head; and C. a cutting blade carried by said bending operation body and confined to sliding relative thereto on said surface portions in opposite directions substantially parallel to said bending axis whereby a cutting edge on said cutting blade, extending substantially parallel to said legs, is carried across said slot to cooperate with said shearing edge for cutting through material that projects forward from the bending head.

2. Apparatus for bending elongated material such as wire, comprising stationary supporting means, a stationary tubular material guide on said supporting means through which material to be bent is advanced in a forward direction and a front portion of which comprises a bending head having a guide bore opening to a front end thereof that defines a bore axis and wherein the material has a close slidable fit to be confined laterally, a direction setting body embracing said material guide and defining a bending axis transverse to said bore axis, said direction setting body being rotatable about said bore axis for varying the orientation of said bending axis and thus establishing the direction in which material projecting forward from said bending head is to be bent, and bending means supported on said direction setting body and movable in opposite directions relative thereto for engaging and bending material that projects forward from the bending head, said bending means being rotatable with said direction setting body relative to the front end of said bending head said apparatus being characterized in that:

A. said bending axis substantially intersects said bore axis and is rearwardly adjacent to the front end of the bending head;

B. said bending means comprises (1) a pinion on said direction setting body confined to rotation relative thereto concentrically to said bending axis, and (2) a bending operation body eccentrically fixed to said pinion and having a wire engaging portion that is swung across said bore axis by rotation of the pinion, to and from a position in which said wire engaging portion is spaced forwardly from said front end of the bending head and is spaced to one side of said bore axis;

C. a rack on said direction setting body confined to lengthwise sliding relative thereto in said forward direction and an opposite rearward direction and meshing with said pinion;

D. a motion transmitting element on said direction setting body confined to motion relative thereto in said forward and rearward directions, said motion transmitting element having (1) a motion transmitting connection with said rack and (2) a flange-like circular peripheral portion concentric to said bore axis that has front and rear surfaces; and E. drive means on said stationary supporting means comprising a member which embraces said peripheral portion of the motion transmitting element to engage its front and rear surfaces and relative to which that element is rotatable about said bore axis, said member being driven for controlled movement in said forward and rearward directions to cooperate with the motion transmitting element and said rack and pinion in effecting swinging of the wire engaging portion of the bending operation body to and from its said position.

3. The apparatus of claim 2, further characterized in that:

(1) said bending operation body is substantially U-shaped, having (a) a pair of legs connected by a laterally extending bight portion, each said leg extending lengthwise substantially transversely to said bending axis, (b) an elongated slot between said legs which is of a width to receive the material to be bent and which has an inner end adjacent to said bight portion that defines said wire engaging portion, and (c) a flat front surface portion on each of said legs, said surface portion on one of said legs being coplanar with that on the other and extending to said slot to define a shearing edge thereat; and (2) a cutting blade carried by said bending operation body and confined to sliding relative thereto on said surface portions in opposite directions substantially parallel to said bending axis whereby a cutting edge on said cutting blade, extending substantially parallel to said legs, is carried across said slot to cooperate with said shearing edge for cutting through material that projects forward from the bending head.

4. The apparatus of claim 2 further characterized by:

a plurality of pairs of chucking rollers confined to rotation at fixed locations on said supporting means that are spaced in the rearward direction from said bending head, the rollers of each pair being clampwise engageable with material to be bent to prevent rotation thereof, said rollers being rotatably driven for continuous forward feeding of the material so that a bend of desired radius can be produced in the material by feeding it forwardly in engagement with said wire engaging portion while the bending operation body is maintained out of its said position.

* * * * *